US006302026B1

(12) United States Patent
Parkes

(10) Patent No.: US 6,302,026 B1
(45) Date of Patent: Oct. 16, 2001

(54) EXPLOSION-SUPPRESSING STRUCTURE

(76) Inventor: John Humphries Parkes, Redhall Mill Colinton Dell, Edinburgh EH14 1JF (GB)

( * ) Notice: Subject to any disclaimer, the term of this patent is extended or adjusted under 35 U.S.C. 154(b) by 0 days.

(21) Appl. No.: 09/392,922

(22) Filed: Sep. 9, 1999

(30) Foreign Application Priority Data

Mar. 10, 1998 (GB) ..... 98050997
Jan. 18, 1999 (GB) ..... 9901058

(51) Int. Cl.[7] ..... F42D 5/00
(52) U.S. Cl. ..... 102/303; 102/323; 102/324
(58) Field of Search ..... 102/303, 323, 102/324

(56) References Cited

U.S. PATENT DOCUMENTS

| | | | | |
|---|---|---|---|---|
| 3,958,286 | | 5/1976 | Rodinsky | 5/335 |
| 4,836,079 | * | 6/1989 | Barrett | 102/303 X |
| 4,836,939 | * | 6/1989 | Hendrickson | 102/303 X |
| 4,905,601 | * | 3/1990 | Gabriel et al. | 102/303 X |
| 5,394,786 | * | 3/1995 | Gettle et al. | 102/303 X |
| 5,719,350 | * | 2/1998 | Parkes et al. | 102/303 |

FOREIGN PATENT DOCUMENTS

| | | |
|---|---|---|
| 0276918 A1 | 1/1988 | (EP) . |
| 1414682 | 3/1973 | (GB) . |
| 2161185 A | 3/1984 | (GB) . |
| 2209775 A | 9/1987 | (GB) . |
| 2289750 A | 9/1994 | (GB) . |
| 2314614 A | 6/1997 | (GB) . |

OTHER PUBLICATIONS

Search Report under Section 17 of Patents Act of 1977 re Application No. GB 9901058.9, dated May 13, 1999.

* cited by examiner

*Primary Examiner*—Peter A. Nelson
(74) *Attorney, Agent, or Firm*—William N. Hogg

(57) ABSTRACT

An explosion-suppressing structure comprises an explosion-suppressing barrier, such as a wall of liquid-filled tanks or blocks, and rupturable explosion-suppressing roof members 23 such as hollow rigid bodies containing liquid-filled bags 24 and supporting further bags 25. In an alternative embodiment, the roof member comprises a net stretched over the barrier.

20 Claims, 4 Drawing Sheets

EXPLOSION-SUPPRESSING STRUCTURE

FIELD OF THE INVENTION

The present invention relates to an explosion-suppressing structure and can in particular be used to protect persons or equipment from munitions exploded under controlled conditions.

BACKGROUND OF THE INVENTION

In my British Patent Application No. 2,314,614A, I described an explosion-suppressing barrier comprising a rigid support member such as a wall of blocks or tanks, rupturable liquid-filled containers being supported on the blocks in the form of bags and/or being defined by cavities in the blocks. Examples of these barriers are shown in FIGS. 1 to 3.

SUMMARY OF THE INVENTION

It is an object of the present invention to provide an explosion-suppressing structure with enhanced protective qualities.

Accordingly, the invention provides an explosion-suppressing structure including at least one explosion-suppressing barrier comprising a permanently rigid support member defining or supporting at least one rupturable liquid-filled container, and further including a roof member spanning the top of the barrier or the tops of at least two of the barriers, the roof member supporting or defining at least one further rupturable liquid-filled container, the liquid being aerozolized in use.

Preferably, the support member comprises a wall of blocks or tanks, which may be of polystyrene, polyurethane or glass-reinforced plastic and which may comprise cavities filled with liquid, optionally contained in rupturable bags, and/or over which rupturable liquid-filled bags may be suspended.

The invention also provides an explosion-suppressing roof member supporting or defining at least one rupturable liquid-filled container, the liquid being aerozolized in use. The roof member may comprise a hollow body of uniform cross-section, and the liquid therein is optionally contained in at least one rupturable bag. The roof member is preferably rigid. A plurality of roof members may be placed adjacent one another to form a roof of the structure. Further rupturable bags of liquid may be placed on top of the or each roof member.

In an alternative embodiment, the roof member comprises a sheet of fabric, preferably reticulated fabric such as a net, tensioned over the top of the barrier(s) and supporting at least one rupturable liquid-filled container (preferably a plurality of rupturable water-filled bags). It is preferable, and in certain circumstances essential, that the structure surrounds a location at which explosive material can be located and from which location any straight line running to the exterior of the structure passes through either the explosion-suppressing barrier or the explosion-suppressing roof member. Embodiments of the invention, therefore, include a stockade in the form of a broken "FIG. 6" or a stockade having an aperture facing a separate barrier. These embodiments allow access into and egress from the structure.

BRIEF DESCRIPTION OF THE DRAWINGS

The invention will now be described in more detail, by way of example only, with reference to the accompanying drawings, in which.

DETAILED DESCRIPTION OF THE INVENTION

Figure 1:
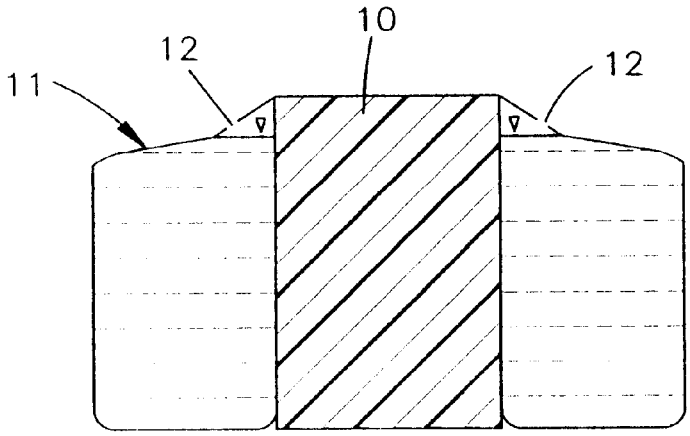
FIG. 1 is a schematic sectional view of part of a barrier for use in a structure according to the invention.

FIG. 1 shows part of a wall of dense polystyrene blocks. A practical size for the blocks is 1.5 m long×0.6 m high×0.4 m wide and one such block is shown at 10. A saddlebag 11, made from a closed length of polyethylene layflat tubing, is suspended over the block 10. The saddlebag is filled via two 45 mm holes at 12 which are cut at suitable points equidistant from the centre. It is desirable that the two holes are at the same level and they are preferably at the highest practical point for filling each individual bag. If these criteria are satisfied, the individual bags will balance each other during and after the filling process and will permit retention of the maximum volume of water.

A number of blocks 10 are placed end to end, and a saddlebag 11 is suspended upon each block, in order to form a single course of the wall, a cross-section of which course is shown in FIG. 1. Subsequently, a further course of blocks is laid on top of the first course and the process is repeated until a wall of the desired height has been constructed. A safe practical height for the wall is 2 m, but greater heights can be achieved if two walls are built side by side and a header "tie course" is laid at right angles to bind the two walls together. Saddlebags are suspended both across the elevation and the gables of the header course, the blocks of which have straight cut ends.

The stretcher course is bonded by means of half blocks in a manner familiar to those skilled in the art of bricklaying. Blocks are manufactured with 45°, thus ensuring a uniform thickness of water. Corners of 45°, such as those shown in FIG. 4, can be obtained by cutting the ends of the blocks at 22½°.

Figure 2:
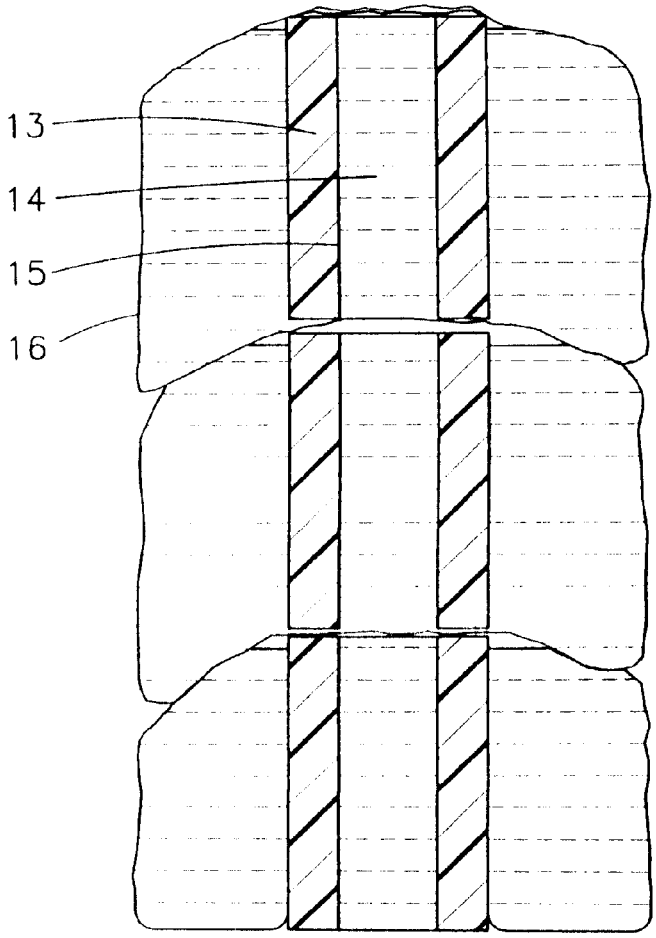
FIG. 2 is a schematic sectional view of an alternative form of barrier.
Figure 3:
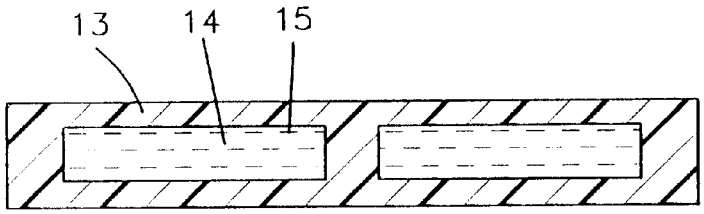
FIG. 3 is a plan view of a block shown in FIG. 2.

The saddlebags suspended from each upper course of the wall overlap the saddlebags of the respective underlying course, which again maintains uniformity in the thickness of water presented at every point along the barrier. The saddlebags 11 of the lowermost course rest on the ground as shown in FIG. 2 and, thus, stabilize the wall. FIGS. 2 and 3 show an alternative embodiment of barrier in which each block 13 of a wall comprises two cuboidal cavities 14 and each cavity contains a polyethylene bag 15 filled with water. In this example, the cavities 14 are bottomless, the bags 15 of the higher courses being supported by the saddlebags 16 of the respective underlying courses, and the bags 15 of the lowermost course resting on the ground.

Alternatively, the cavities could be formed in the blocks by hollowing out from above, leaving a base for each cavity. In this case, it is unnecessary to insert bags into the cavities, which can be filled directly with water. Moreover, where the volume of the cavity is large in relation to the thickness of the sides of the "blocks", it will be appreciated that the elements of the wall are actually tanks of water.

The embodiments shown in FIGS. 1 and 3 are particularly useful in situations where a building, aircraft or the infrastructure surrounding a given location is to be protected from the effects of overpressure and heat resulting from an explosion at that location. The barriers of these embodiments break up in use and since they are made from polystyrene blocks, no damaging material is projected towards the protected item. Any metallic fragments from a shell or bomb (including an improvised vehicle bomb) strike the wall first and are arrested by the mass of water, their impact causing some of the water to be thrown into the air which in turn attenuates the following pressure wave.

According to the invention, barriers such as those shown in FIGS. 1 to 3, but which may alternatively be of the easel type also described in GB-A-2314614, are used to support roof members which in turn define or support further rupturable liquid-filled containers such as water-filled bags.

Figure 4:
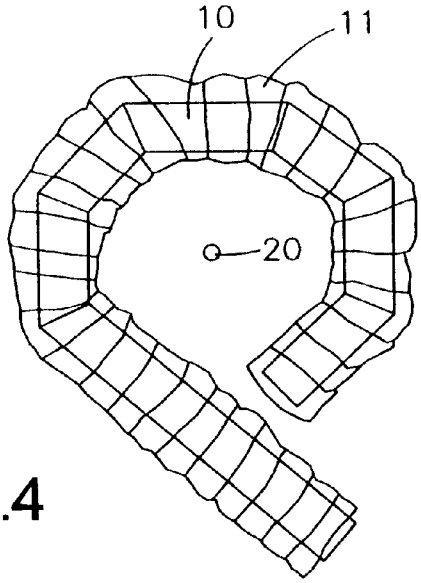
FIG. 4 is a schematic plan view of an explosion-suppressing structure according to an embodiment of the invention, but not showing the roof members.

In order to enclose a munition to be disposed of by means of a structure protecting persons or objects located outside the structure, a series of walls, for example of the type shown in FIG. 2, are firstly erected to form a stockade. FIG. 4 shows such a stockade in the form of a broken "FIG. 6", the blocks 10 of the uppermost course being draped with saddlebags 11. The stockade surrounds a munition 20 in such a manner that whilst access to and egress from the stockade is afforded, any straight line drawn from the munition to the exterior, representing a path which fragments may follow after detonation, passes through one of the walls or the roof members described below.

Figure 5:
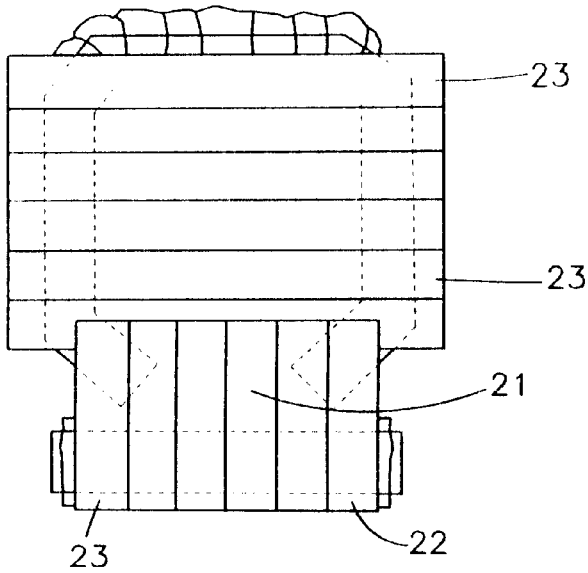
FIG. 5 is a schematic plan view of a structure according to another embodiment.

FIG. 5 shows an alternative structure, substantially square in plan and having an aperture 21 in one side, a receptor wall 22 facing the aperture so as to intercept fragments or other blast effects emitted through the aperture 21. Roof members 23 span the walls of the structure. The roof members can be manufactured from plywood, fibreglass, glass reinforced nylon, other plastic materials or a combination of more than one of these materials. The materials are selected so that no hard or injurious fragments can be created in the blast beyond a minimum safe distance. The roof members 23 generally comprise tubular components of square or rectangular cross-section, each roof member 23 containing a closed length 24 of water-filled polyethylene layflat tubing (see FIG. 6). I have found cross-sectional dimensions of 300 mm×300 mm or 300 mm×150 mm to be useful, but these dimensions can be varied depending on the load bearing ability sought to be achieved.

Once a covering of one or more layers of roof members 23 is placed over the barrier, additional water-filled bags, which may be saddlebags, can be supported thereon if the degree of blast protection is required to be further enhanced. For example, bags 25 can be laid on top of the roof members 23 as shown in FIG. 6, or saddlebags can be suspended from the roof members themselves.

Figure 6:
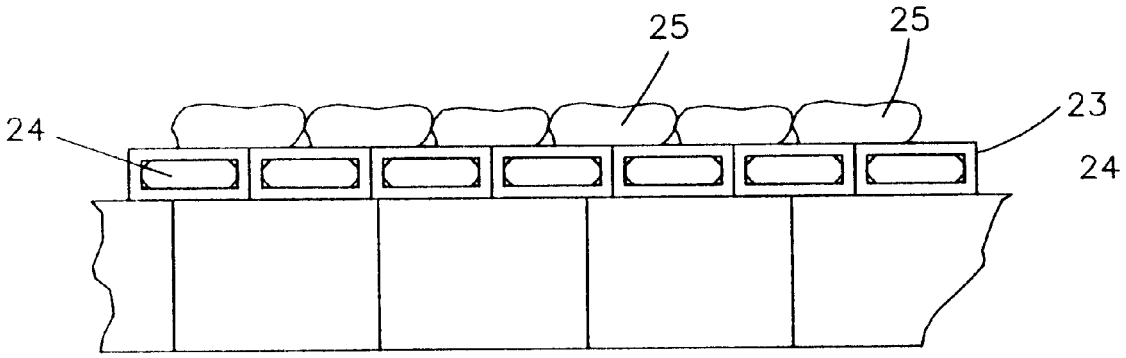
FIG. 6 is a side view of a structure according to a further embodiment.

The arrangement shown in FIG. 6 is advantageous in that the additional bags 25 protect the areas devoid of water in the roof members 23 due to the juxtaposition of two adjacent roof members and the thickness of the materials forming the roof members. These areas may only be 20 mm wide but might be penetrated by high velocity fragments, rendering the bags 25 necessary.

Figure 7:
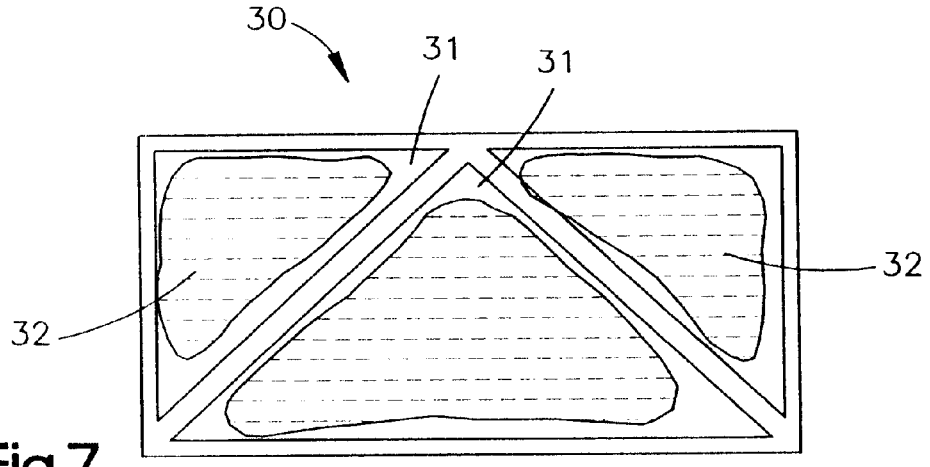
FIG. 7 is a schematic plan view of a roof member.

FIG. 7 shows an alternative roof member 30, the interior of which is divided into sections 31 which are triangular in plan and each of which contains a water-filled polyethylene bag 32. The roof member 30 can be made wider than the roof members 23 described above and the internal oblique partitions add strength to the roof member 30. However, preferably each member 30 is small enough and light enough, in its unfilled state, to be carried and positioned by one person.

Figure 8:
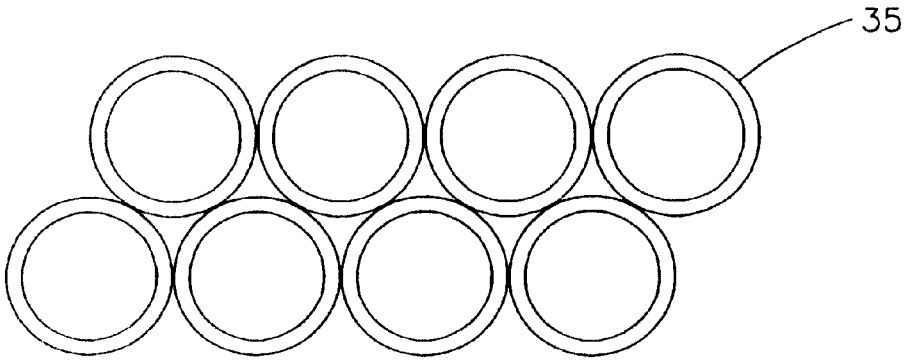
FIG. 8 is a schematic section of roof members of an alternative form.

Further alternative roof members 35 are shown in FIG. 8 and comprise cylindrical tubing of plastic material, stacked in layers in a staggered configuration to ensure a uniform thickness of water.

It is not essential for the roof members 23, 30 or 35 to contain liquid-filled bags and, in the alternative, the roof members can be made liquid-tight and filled directly with liquid. However, the liquid-tight integrity of such members must not be compromised by storage or damaged in transit, and the use of bags formed from layflat polyethylene tubing represents an inexpensive and practical option.

Figure 9:
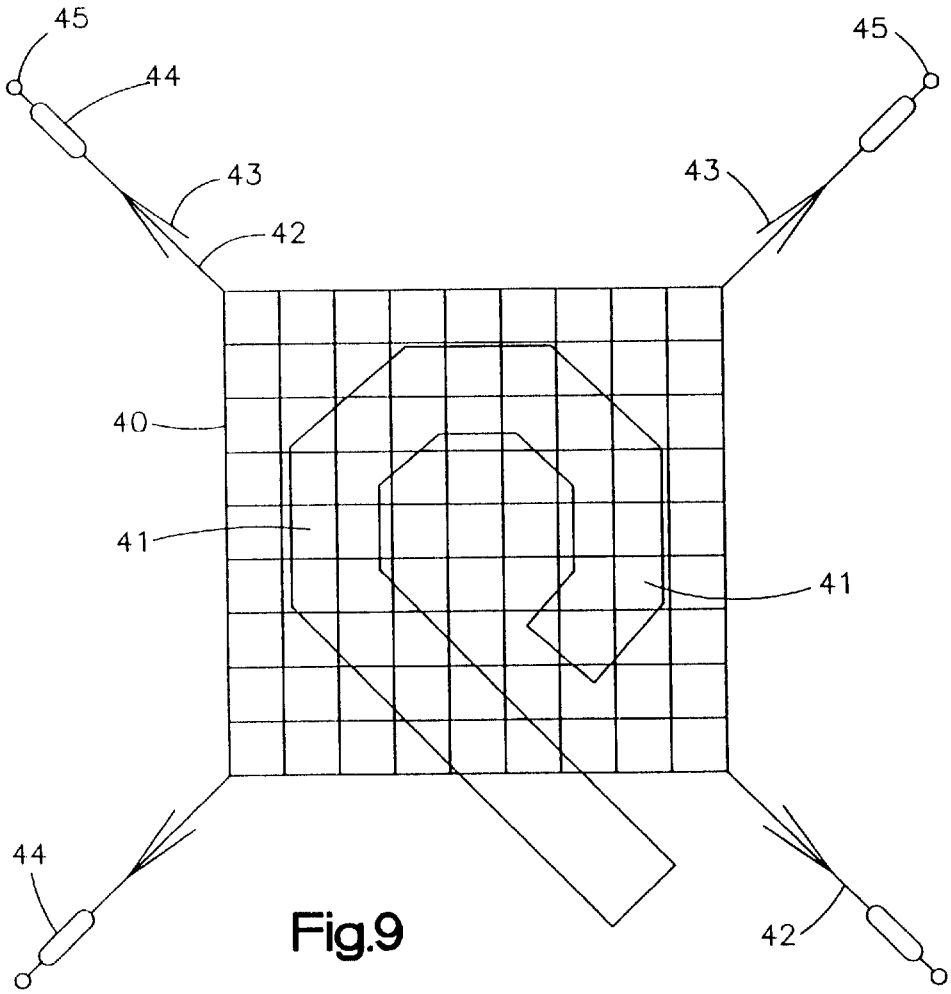
FIG. 9 is a schematic plan view of a structure according to an alternative embodiment of the invention.
Figure 10:
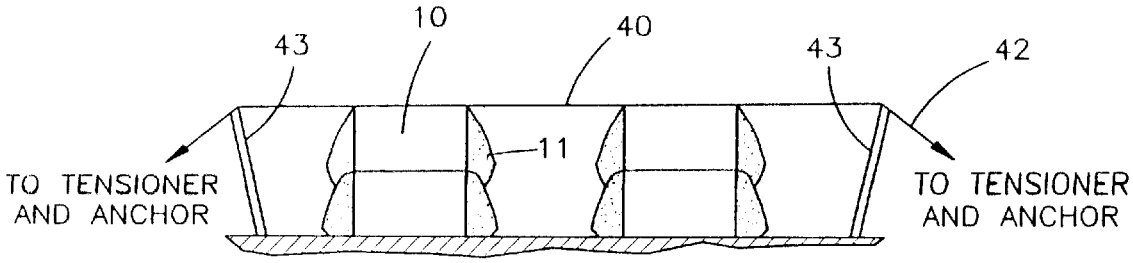
FIG. 10 is a schematic elevation, partly in section, of the structure shown in FIG. 9.

FIGS. 9 and 10 show another embodiment of the invention in which the roof member comprises a net 40 which is extended over the top of walls 41 after the latter have been erected. Once the net has been properly tensioned as described below, water-filled saddlebags formed from polyethylene layflat tubing (not shown in the figures) can be suspended over the strands of the net or water-filled bags can be laid on planar members, such as sheets of plywood which have been placed on the net 40. It is also possible to deploy a second net over the first net, or to fold a single large net into two layers and to suspend water-filled saddlebags from one layer and place planar members and further water-filled bags on the other layer.

The net 40 may be formed from any suitable material, such as polypropylene, nylon, hemp or sisal. Steel rope can also be used to form the net since it will not present a serious fragment hazard beyond a reasonably small safety radius. However, care should be taken not to damage any of the rupturable bags by contact with any frayed sections of the net.

The net 40 must be deployed over the walls 41 such that the angle of the ropes or cables 42 forming the tensioning mechanism does not pull the walls over. To this end, the tensioning ropes 42 are stretched over "A" frames 43 which are suitably of timber. In particular, the timber used can be box-section plywood, since even when an "A" frame of this material is struck by fragments of the explosion-suppressing structure, and ultimately destroyed by the explosively driven water, the timber fragments do not present a serious hazard beyond a predetermined safety distance. Each tensioning rope 42 carries a tensioning mechanism 44, such as a "Tirfor" jack or a "Sylvester" (trademarks). The tensioning ropes 42 are attached to ground anchors 45 which may be Ordnance Pattern Holdfast systems or simple timber pickets or buried timber bulks.

The tensioning ropes 44 are designed to break at a predetermined tension, thus preventing fragments of the "A" frames 43, tensioning ropes 44 and net 40 from being subjected to excessive strain and subsequently damaging the tensioning equipment when the latter is explosively driven away. Thus, during an explosion, the ground anchors 45 remain in place and the tensioning mechanisms 44 remain intact for re-use whilst the remaining elements of the structure are usually destroyed.

As well as the explosive destruction of munitions, the exposition-suppressing structures of the invention can be used to safeguard against the effects of explosions which may accidentally occur during such processes as intrusive abrasive water jet cutting or the steam removal of an explosive filling. The surfaces of the liquid-filled bags on the interior of the structure can be protected from possible damage caused by the process being undertaken by means of sheets of heavy duty polyethylene, plywood, tarpaulin, PVC or the like. The underside of the roof member or members will only require such protection if liquid-filled saddlebags have been suspended from the roof member or members.

The roof members of the invention, particularly those shown in FIGS. 5, 6, 7 and 8, can alternatively be used in situations where the walls of a structure do not support or define liquid-filled containers. Thus, a structure could be built with strong blast-reflecting walls, shock waves and ejected fragments being attenuated and caught by the water in the rupturing roof members.

I claim:

1. An explosion-suppressing structure comprising support walls, a separate roof comprised of at least one member, at least one of said members being a support member and at least one of said members being a rupturable liquid-filled container, the liquid being aerozolizable responsive to an explosion that ruptures said at least one container.

2. A roof member according to claim 1 wherein said liquid filled container includes at least one rupturable liquid-filled bag.

3. A roof member according to claim 2 wherein said at least one rigid support member includes a sheet of fabric-supporting said at least one liquid filled container.

4. A roof member according to claim 3, wherein the fabric is reticulated.

5. A roof member according to claim 1, wherein said at least one rupturable liquid container comprises at least one liquid-containing hollow body of uniform cross-section.

6. A roof member according to claim 2, wherein said at least one rupturable liquid container comprises at least one liquid-containing hollow body of uniform cross-section.

7. A roof member according to claim 5 wherein said at least one liquid filled container is said rigid support member.

8. A roof member according to claim 6 wherein said at least one liquid filled container is said rigid support member.

9. An explosion-suppressing structure including at least one explosion-suppressing barrier comprising a permanently rigid support member defining or supporting at least one rupturable support member, and further including a roof spanning the top of the barrier, the roof having at least one member, at least one of said members being a support member and at least one member having at least one liquid filled container, said liquid being aerozolizable responsive to an explosion that ruptures said at least one container.

10. A structure according to claim 9, wherein the support member comprises a wall of blocks or tanks.

11. A structure according to claim 10, wherein the blocks or tanks are of polystyrene, polyurethane or glass-reinforced plastic.

12. A structure according to claim 10, wherein the blocks or tanks comprise cavities filled with liquid.

13. A structure according to claim 9, wherein any straight line running to the exterior of the structure from a central location inside the structure passes through either the explosion-suppressing barrier or the explosion-suppressing roof.

14. A structure according to claim 10, wherein any straight line running to the exterior of the structure from a central location inside the structure passes through either the explosion-suppressing barrier or the explosion-suppressing roof.

15. A structure according to claim 12, wherein any straight line running to the exterior of the structure from a central location inside the structure passes through either the explosion-suppressing barrier or the explosion-suppressing roof member.

16. The structure according to claim 9, wherein the container includes at least one rupturable liquid-filled bag.

17. The structure according to claim 9, wherein the at least one rigid support member includes a sheet of fabric supporting said at least one liquid-filled container.

18. The structure according to claim 17, wherein the fabric is reticulated.

19. The structure according to claim 9, wherein the liquid filled container includes at least one liquid-containing hollow body of uniform cross-section.

20. The structure according to claim 19, wherein said liquid filled container is said rigid member.

* * * * *